US006564716B1

(12) United States Patent
Steele et al.

(10) Patent No.: US 6,564,716 B1
(45) Date of Patent: May 20, 2003

(54) FUZES HAVING CENTRIFUGAL ARMING LOCK FOR A MUNITION

(75) Inventors: Michael F. Steele, Cincinnati, OH (US); William Marc Schmidt, Batavia, OH (US); Ezra Stearns Waller, Sharonville, OH (US)

(73) Assignee: KDI Precision Products, Inc., Cincinnati, OH (US)

( * ) Notice: Subject to any disclaimer, the term of this patent is extended or adjusted under 35 U.S.C. 154(b) by 0 days.

(21) Appl. No.: 10/006,739

(22) Filed: Dec. 5, 2001

(51) Int. Cl.[7] ..... F42C 15/22; F42C 15/32; F42C 15/18

(52) U.S. Cl. ..... 102/239; 102/237; 102/225; 102/223; 102/224; 102/226; 102/221; 102/242; 102/243; 102/244; 102/245

(58) Field of Search ..... 102/221–223, 102/231, 237, 247, 239, 251, 242, 243, 244, 245, 224, 226, 225, 230

(56) References Cited

U.S. PATENT DOCUMENTS

| | | | | | |
|---|---|---|---|---|---|
| 126,711 | A | * | 5/1872 | Moir | |
| 198,353 | A | * | 12/1877 | Chollar | |
| 939,447 | A | * | 11/1909 | Schneider | 102/222 |
| 1,561,878 | A | * | 11/1925 | Methlin | 102/243 |
| 1,648,603 | A | * | 11/1927 | Barker | 102/242 |
| 1,762,674 | A | * | 6/1930 | Teitscheid | 102/245 |
| 3,500,748 | A | * | 3/1970 | Hager et al. | 102/222 |
| 3,998,164 | A | * | 12/1976 | Hadfield | 102/226 |
| 4,653,402 | A | | 3/1987 | Halssig et al. | |
| H000251 | H | * | 4/1987 | Field | |
| 4,662,278 | A | * | 5/1987 | Lillios | 102/223 |
| 4,726,292 | A | * | 2/1988 | Gatti | |
| 4,811,664 | A | | 3/1989 | Levy et al. | |
| 4,852,496 | A | * | 8/1989 | Campagnuolo et al. | 102/322 |
| 5,549,047 | A | | 8/1996 | Borgni | |
| 5,576,510 | A | | 11/1996 | Rudenauer | |
| 5,625,161 | A | * | 4/1997 | Nicolas et al. | |
| 5,705,766 | A | | 1/1998 | Farace et al. | |
| 6,237,495 | B1 | | 5/2001 | Hok et al. | |
| 6,405,652 | B1 | * | 6/2002 | Hoffmann et al. | |

FOREIGN PATENT DOCUMENTS

| | | | |
|---|---|---|---|
| CH | 667527 A5 | * | 10/1988 |
| FR | 2672673 | * | 8/1992 |

* cited by examiner

*Primary Examiner*—Michael J. Carone
*Assistant Examiner*—Lulit Semunegus
(74) *Attorney, Agent, or Firm*—Harness, Dickey & Pierce, PLC

(57) ABSTRACT

A fuze for a munition adapted to prevent unintended arming thereof. The fuze incorporates an arming screw having a keyed portion and a centrifugal locking mechanism for preventing rotation of the arming screw unless the fuze mechanism is in a rapidly spinning condition such as that experienced when the fuze and its associated munition are deployed from an airborne rocket or artillery shell, and thus spinning at a rate of at least several thousand rpm. The centrifugal locking mechanism includes a pair of locking members which are biased by biasing elements into engagement with the keyed portion of the arming screw. This prevents the arming screw from being accidentally unscrewed from an inertia weight within the fuze, thus placing the fuze in an unintended armed condition. However, when the munition is deployed from an airborne rocket or artillery shell, and thus reaches a spinning rate of several thousand rpm or higher, the centrifugal force acting on the locking members forces them out of engagement with the keyed portion. This allows the arming screw to unscrew from the inertia weight and arm the fuze.

21 Claims, 4 Drawing Sheets

FIG. 1.
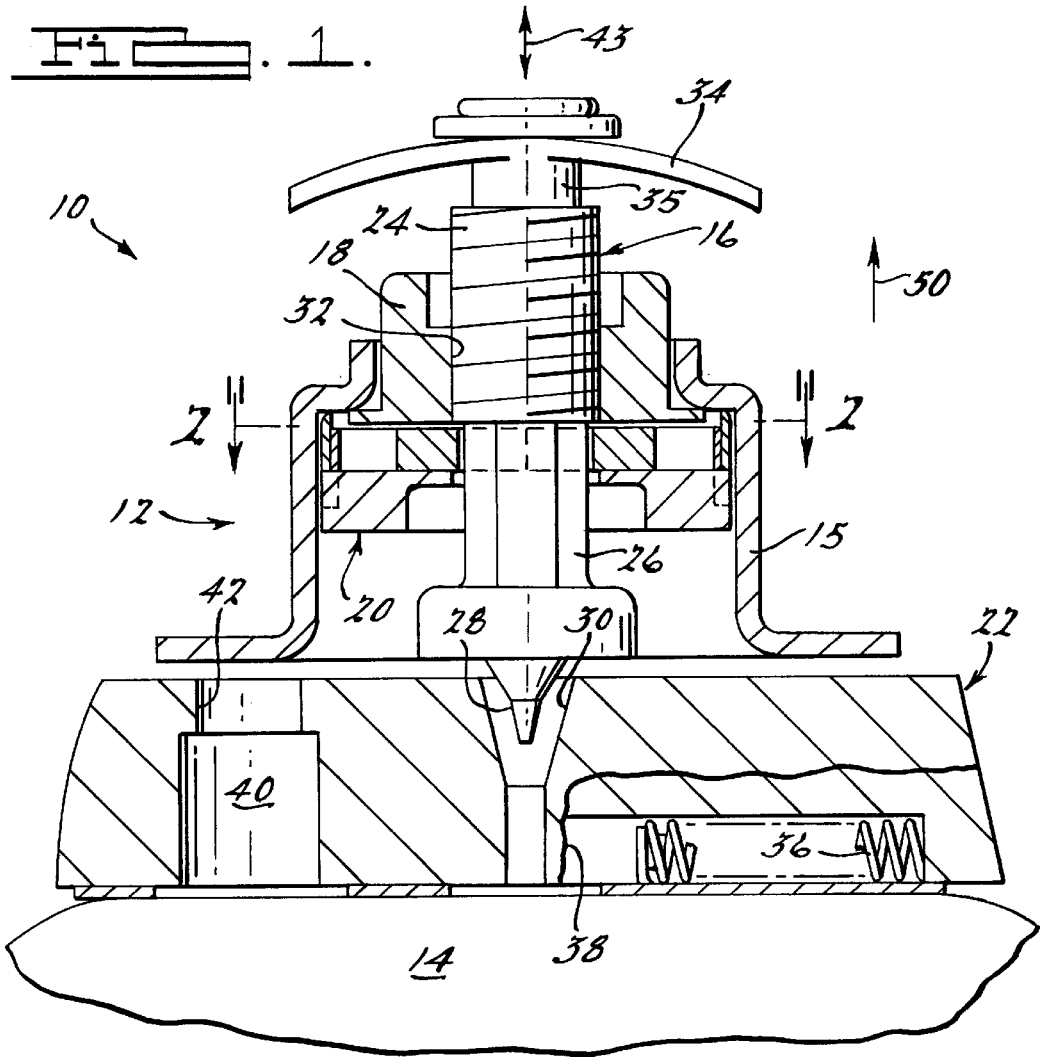
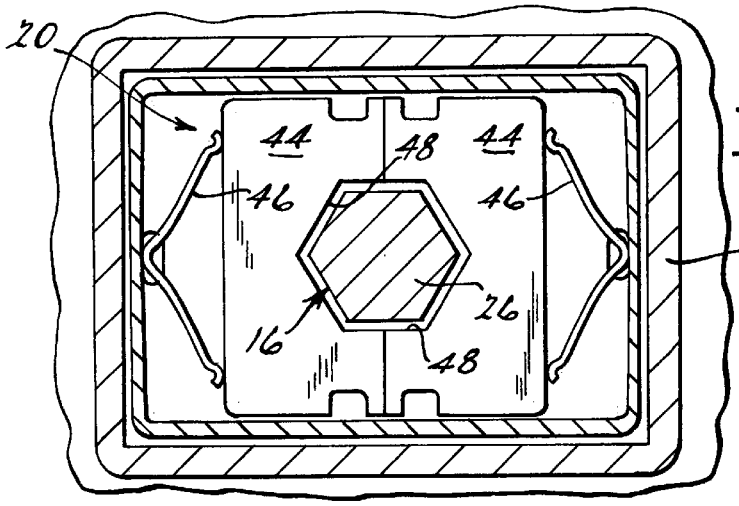
FIG. 2.

FUZES HAVING CENTRIFUGAL ARMING LOCK FOR A MUNITION

BACKGROUND OF THE INVENTION

1. Technical Field

This invention relates to fuzes for munitions such as grenades, and more particularly to a fuze having a centrifugal lock for allowing arming of the fuze only when its associated munition is deployed from an airborne projectile.

2. Discussion

Fuzes are used in a variety of applications with various forms of munitions to arm a munition so that the munition can be detonated. With grenades adapted for airborne deployment, such as from artillery shells, such grenades typically employ an arming screw having a firing pin portion. A drag ribbon is typically attached to one end of the arming screw. Arming of the fuze is accomplished when the fuze and its associated munition are deployed from an airborne rocket or artillery shell and the munition begins falling toward the Earth while it is spinning at a very high rate. During this time the drag ribbon causes the arming screw to be unscrewed from an interior inertia weight. As the arming screw becomes fully unscrewed from the inertia weight other components within the fuze are allowed to move to place a detonator device in line with the firing pin of the arming screw. Upon impact with a target or ground surface, the inertia weight assists in driving the tiring pin into the detonator to detonate the main explosive charge of the munition.

One problem with the above-described fuze mechanism is that unintentional arming of the fuze may occur under certain conditions. For example, if the munitions housed within an artillery shell carried on board a war ship are released therefrom, such as if the ship is struck by an enemy missile, the potential exists for the munitions to roll around on the deck of the ship. During this time, there is the possibility that the arming screw of a fuze mechanism of one or more of the munitions may become unthreaded from its associated inertia weight. In this instance, any such fuze mechanism having its arming screw fully unthreaded would be placed in an armed yet undetonated condition.

Thus, it is a principal object of the present invention to provide a fuze for a munition which prevents arming of the munition unless the munition is deployed from an airborne rocket or artillery shell. More specifically, it is an object of the present invention to provide a fuze mechanism which cannot be placed in an armed condition merely by the munition rolling around on a ship deck, ground surface or other like, relatively flat area.

It is still a further object of the present invention to provide a fuze for a munition which can only be armed by placing the munition in a highly rapidly spinning condition, such as when the munition is deployed from an airborne rocket or artillery shell, and where the rate of spin of the munition is on the order of several thousand rpm.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

SUMMARY OF THE INVENTION

The above and other objects are provided by a fuze mechanism in accordance with preferred embodiments of the present invention. The fuze mechanism includes an arming screw and a centrifugal locking mechanism. The centrifugal locking mechanism engages a portion of the arming screw and prevents rotation of the arming screw unless the fuze mechanism is spinning at a rate sufficiently high so as to generate a predetermined degree of centrifugal force to release the centrifugal locking mechanism from engagement with the arming screw. As a result, the arming screw can only begin to unscrew from the fuze mechanism when the fuze mechanism and its associated munition is placed in a highly spinning condition, such as that which occurs when the fuze and its munition are deployed from an airborne rocket or artillery shell and the rate of spin is typically several thousand rpm or greater.

In one preferred embodiment the centrifugal locking mechanism comprises a pair of locking members and the arming screw comprises a keyed portion. Each of the locking members further includes cutouts formed in accordance with the keyed portion of the arming screw such that the locking members can engage the keyed portion securely. A pair of biasing elements are also used to hold the locking members in engagement with the keyed portion of the arming screw. The biasing elements provide a biasing force sufficient to hold the locking members securely against the keyed portion of the arming screw when the fuze is not spinning or is spinning at a low rate of rotation, but which allow centrifugal force acting on the locking members to urge them out of engagement with the keyed portion of the arming screw when the fuze reaches a high rate of spin that only occurs during airborne deployment of munitions from rockets or artillery shells. As such, the locking members are not able to be disengaged from the keyed portion of the arming screw in the event that the fuze and its associated munition is released onboard a ship deck or any other relatively flat surface where it is able to roll.

The centrifugal locking mechanism thus provides an effective yet relatively simple means for preventing rotation of the arming screw except when the fuze is deployed from an airborne rocket or artillery shell. Importantly, the centrifugal locking mechanism does not add significantly to the cost of the fuze or require enlarging the dimensions of the fuze or significantly increase its complexity.

BRIEF DESCRIPTION OF THE DRAWINGS

The present invention will become more fully understood from the detailed description and the accompanying drawings, wherein:

The various advantages of the present invention will become apparent to one skilled in the art by reading the following specification and subjoined claims and by referencing the following drawings in which:

FIG. 1 is a side cross sectional view of a fuze in accordance with a preferred embodiment of the present invention secured to a primary explosive device;

FIG. 2 is a cross sectional view of the fuze of FIG. 1 taken in accordance with direction line 2—2 in FIG. 1;

DETAILED DESCRIPTION OF THE PREFERRED EMBODIMENTS

Figure 3:
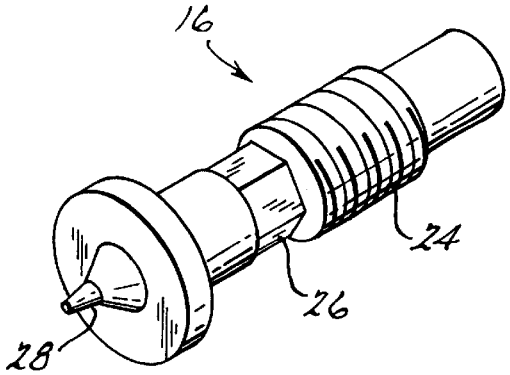
FIG. 3 is a perspective view of the arming screw of the fuze of FIG. 1.

The following description of the preferred embodiment(s) is merely exemplary in nature and is in no way intended to limit the invention, its application, or uses.

Referring to FIG. 1, there is shown a munition 10 incorporating a fuze mechanism 12 in accordance with a preferred embodiment of the present invention and a main explosive charge 14. The fuze 12 incorporates a fuze housing 15 having an arming screw 16 and inertia weight 18, a centrifugal locking mechanism 20 and a slide member 22.

With further reference to FIGS. 1 and 3, the arming screw 16 includes a threaded portion 24, a keyed portion 26 and a firing pin 28. The firing pin 28 is engaged within a bore 30 in the slide member 22 when the fuze 12 is in an unarmed condition. The weight 18 includes a threaded portion 32 with which the threaded portion 24 of the arming screw 16 is engaged. A drag ribbon 34 coupled to the arming screw 16 via a rivet 35 assists in unscrewing the arming screw 16 from the threaded portion 32 when the munition 10 is deployed from an airborne rocket or artillery shell while in a rapidly spinning condition, which causes the firing pin 28 to be withdrawn from the bore 30 in the slide member 22. When this occurs, a spring 36 disposed within a cavity 38 of the slide member 22 causes the slide member 22 to be urged laterally (i.e., to the right in FIG. 1), thus placing a stab detonator 40 carried within a bore 42 of the slide member 22 in alignment with the firing pin 28. Upon impact with a target or ground surface, the inertia of weight 18 assists in driving the firing pin 28 into the stab detonator 40 thus detonating it. This in turn causes detonation of the primary explosive charge 14.

A principal advantage of the fuze mechanism 12 is the inclusion of the centrifugal locking mechanism 20 which prevents rotation of the arming screw 16 unless the fuze 12 is rapidly spinning about longitudinal axis 43 in FIG. 1. More particularly, the centrifugal locking mechanism 20 prevents rotation of the arming screw 16 unless the fuze 12 is spinning about the axis 43 at a rate of several thousand rpm, and more preferably at least about 5,000 rpm, and most preferably between about 7,000–8,000 rpm.

Figure 4:
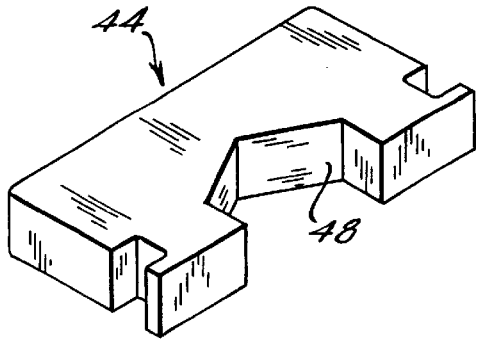
FIG. 4 is a perspective view of one of the locking members of the centrifugal locking mechanism.

The centrifugal locking mechanism 20 is also shown in FIG. 2. Locking mechanism 20 includes a pair of opposing locking members 44 biased into engagement with the keyed portion 26 of the arming screw 16 by a pair of biasing elements 46. One of the locking members 44 is also shown in FIG. 4. In one preferred embodiment, the keyed portion 26 comprises a hexagonal shape when viewed in cross section, as indicated in FIG. 2. Each of the locking members 44 similarly include cutouts 48 which essentially form one-half of an hexagonal opening. Thus, when the cutouts 48 of the locking members 44 are engaged with the keyed portion 26 of the arming screw 16 and held against the keyed portion by the biasing elements 46, the arming screw is prevented from rotating. However, when the fuze mechanism 12 is placed in a rapidly spinning condition, such as when deployed from a rocket or artillery shell (where the rate of spin of the fuze 12 is on the order of several thousand rpm), the centrifugal force acting on the locking members 44 forces them away from each other against the biasing force of biasing elements 46, thus allowing the arming screw 16 to begin rotating. In this manner, rotation of the arming screw 16 is prevented until the fuze mechanism 12 is placed in the above-described rapidly spinning condition. As such, mere rolling of the fuze mechanism 12 on a surface such as a ship deck or ground surface will not generate sufficient centrifugal force on the locking members 44 to cause them to disengage from the keyed portion 26 of the arming screw 16. Thus, such a condition does not allow the fuze mechanism 12 to become armed.

Figure 5:
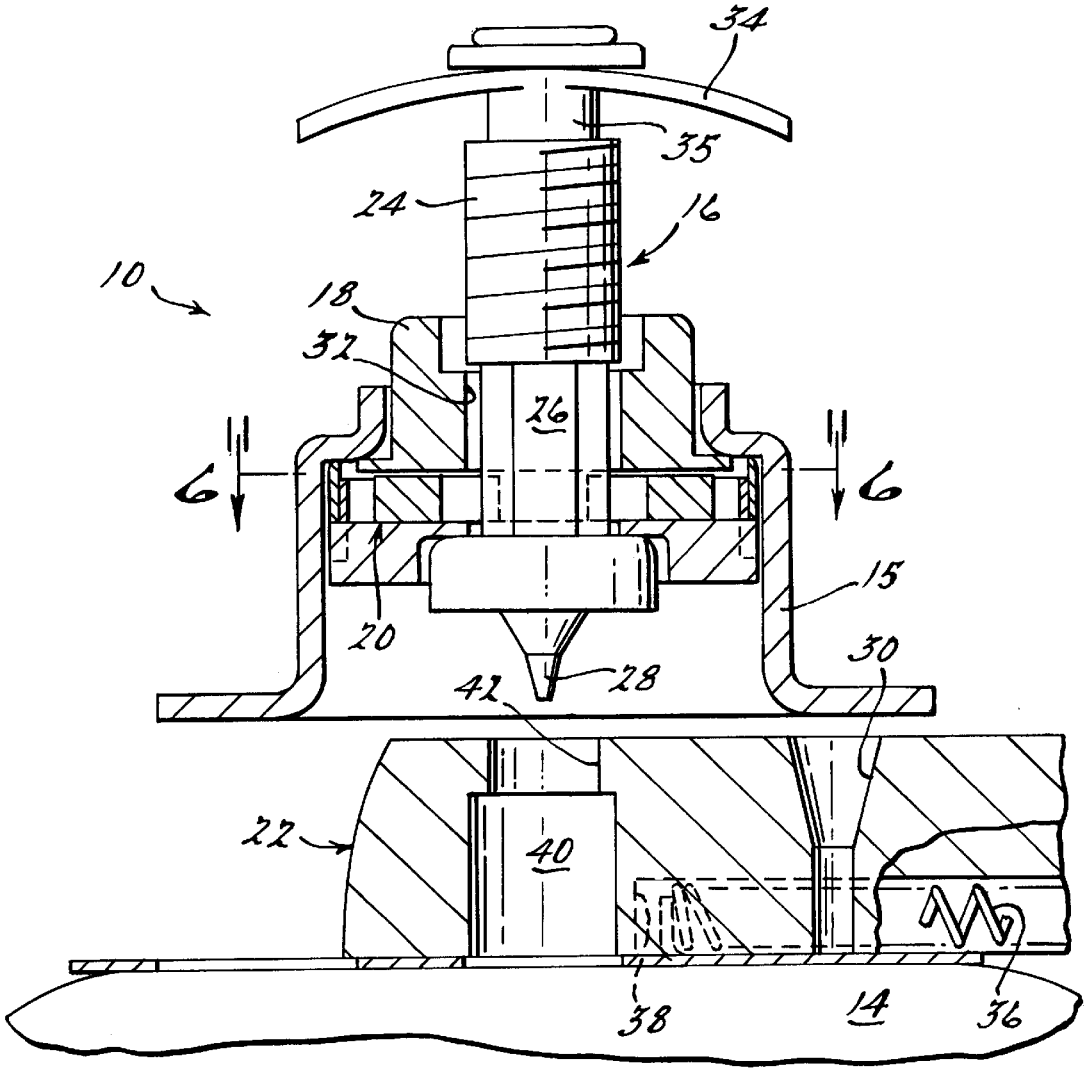
FIG. 5 is a view of the fuze mechanism shown in FIG. 1 but with the fuze mechanism in an armed condition.
Figure 6:
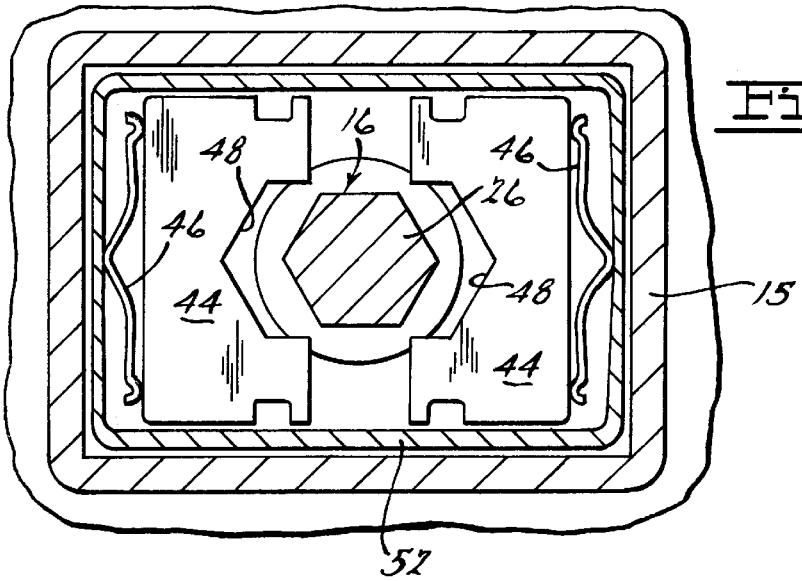
FIG. 6 is a cross sectional view of the centrifugal locking mechanism of FIG. 5 taken in accordance with direction line 6—6 in FIG. 5 showing the centrifugal locking mechanism with the locking members thereof held in disengaged positions relative to the keyed portion of the arming screw.

The biasing elements 46 require a high spin rate to deploy, preferably on the order of several thousand rpm. The arming screw 16 unthreading torque is preferably less than about 1.0 inch-ounce when the arming screw 16 is subjected to a force of about one pound in the direction shown by arrow 50 in FIG. 1. The centrifugal locking mechanism 20 is shown in its unlocked position in FIGS. 5 and 6. The arming screw 16 is shown fully unthreaded from the weight 18, thus placing the fuze 12 in an armed condition. The arming screw 16 is able to function at torques of less than 1.0 inch ounce when the locking members 44 are fully deployed owing to the centripetal spin forces.

Figure 7:
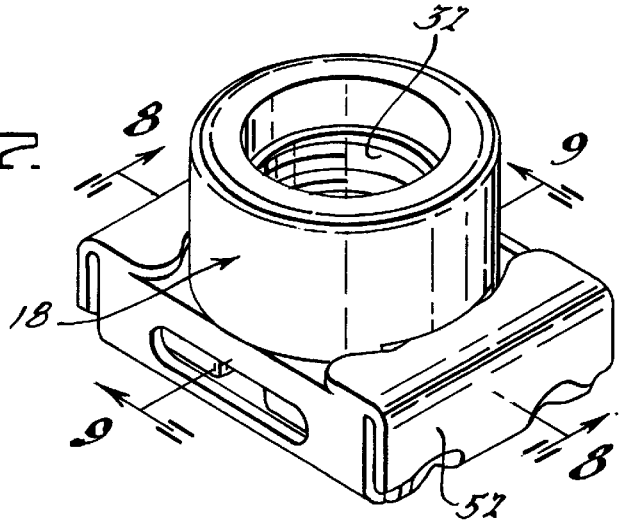
FIG. 7 is a perspective view of a spin lock member used to hold the centrifugal locking mechanism to the weight.
Figure 8:
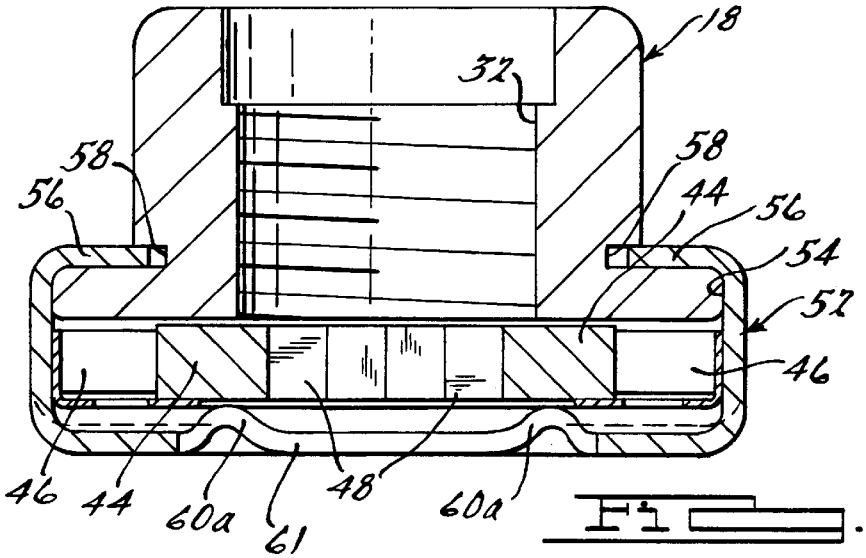
FIG. 8 is a cross sectional side view of the assembly shown in FIG. 7 taken in accordance with direction line 8—8 in FIG. 7.
Figure 9:
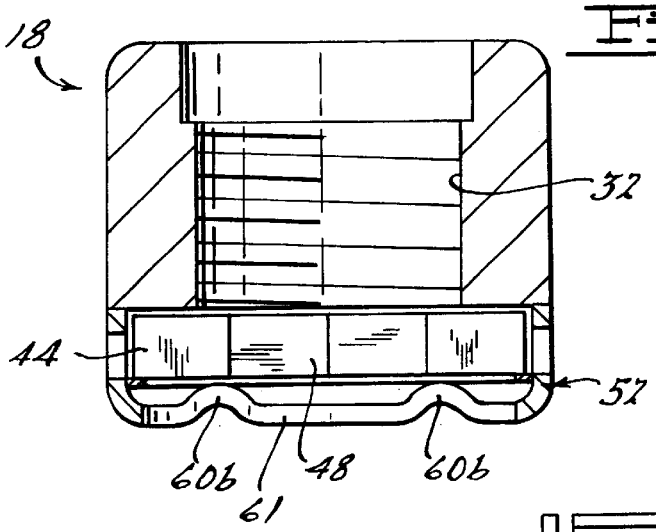
FIG. 9 is a cross sectional side view of the assembly of FIG. 7 taken in accordance with section line 9—9 in FIG. 7.
Figure 10:
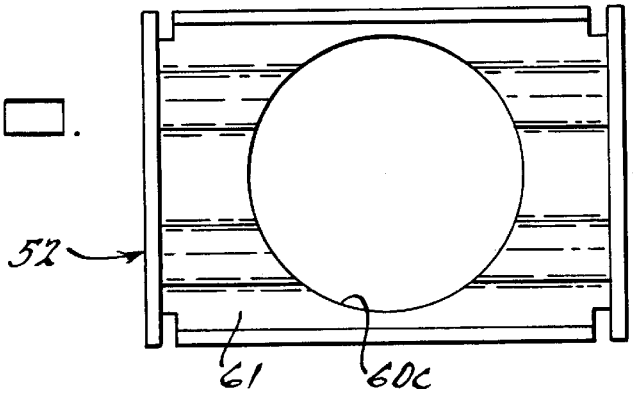
FIG. 10 is a plan view of just the spin lock member of FIG. 8.
Figure 11:
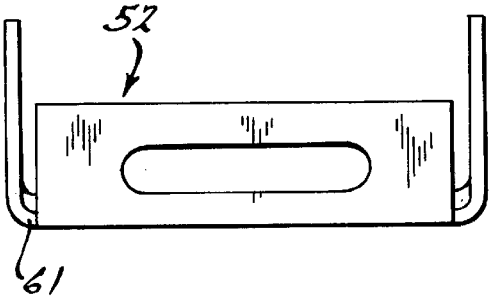
FIG. 11 is a side view of the spin lock member of FIG. 10.

Referring now to FIGS. 7–9, the assembly of the centrifugal locking mechanism 20 relative to the weight 18 can be seen in even greater detail. A stamped spin lock housing 52, also shown in FIGS. 10 and 11, is employed to form a cavity 54 (visible in FIG. 8) within which the locking members 44 can be held in close proximity to the keyed portion 26 of the arming screw 16. The spin lock housing 52 is preferably formed from a single piece of suitably strong material such as steel and includes flanges 56 which can be folded so as to engage within recesses 58 (best seen in FIG. 8) in the weight 18. Pairs of optional ribs **60*a* (FIG. 8) and 60*b* (FIG. 9) may be formed in a bottom wall 61 to assist in supporting the locking members 44. A large aperture 60*c* allows the keyed portion 26 of the arming screw 16** to extend therethrough.

Figure 12:
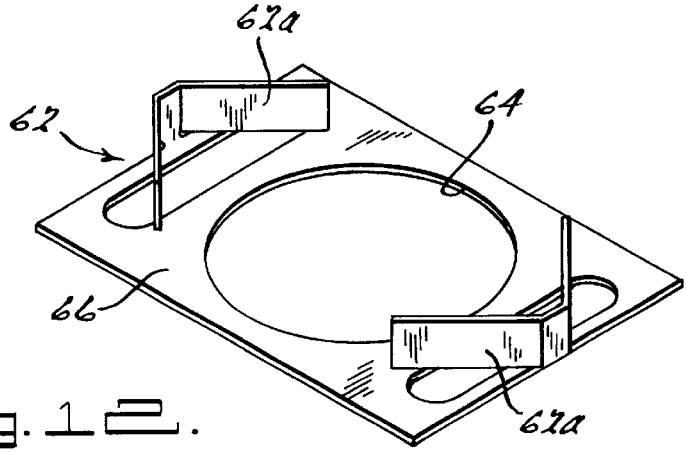
FIG. 12 is a perspective view of a plate incorporating the biasing elements used to bias the locking members of the centrifugal locking mechanism.

With reference to FIG. 12, an alternative preferred arrangement for providing the biasing elements 46 is illustrated in the form of a metal plate 62 from which biasing elements **62*a* may be integrally formed and bent into the V-shaped orientations shown. A central aperture 64 is included for allowing the keyed portion 26 of the arming screw 16 to extend therethrough. A base 66 rests on the bottom wall 61 of the spin lock member 52 and supports the locking members 44 thereon. It will be appreciated, however, that a wide variety of different forms of biasing elements could be included in lieu of the V-shaped biasing elements 46 or the plate 62 shown and described herein. Essentially, any form of biasing element capable of providing a suitably strong biasing force against the locking members 44 to hold the locking members securely against the keyed portion 26 of the arming screw 16 could be employed. Also, while a pair of biasing elements 46 are illustrated, it will be appreciated that a single biasing element acting on a single locking member could also be employed. Additionally, the function of the locking member 44 and the keyed portion 26 in holding the arming screw 16 stationary could be provided by any interengagement of elements that prevents rotation of the arming screw 16** except when a rate of spin of several thousand rpm is reached.

The centrifugal locking mechanism 20 does not require the envelope of the housing 14 of the fuze 12 mechanism to be enlarged nor does it add significantly to the complexity or cost of the fuze. The centrifugal locking mechanism 20 forms a reliable yet relatively simple means for preventing accidental arming of the fuze mechanism 12 in those instances where the munition 10 may be released upon a ship deck or ground surface and caused to roll around, which action could potentially cause other previously developed fuze mechanisms to become armed. The fuze mechanism 12 of the present invention thus only becomes armed when it is placed in a highly spinning airborne condition such as that which would be experienced after being ejected from an airborne rocket or projectile traveling at a high rate of speed.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A fuze for a munition adapted to become armed only when said munition is deployed from a rapidly spinning airborne projectile, said fuze comprising:

a fuze housing;

an arming member disposed at least partially within said fuze housing and adapted to rotate about a longitudinal axis thereof when said fuze and its associated munition are deployed from a rapidly spinning airborne projectile, said arming member having a keyed portion;

a centrifugal locking system disposed within said fuze housing and having at least one locking member and a biasing element for biasing said locking member into engagement with said keyed portion of said arming member to thereby prevent said arming member from being unthreaded and to maintain said arming member in an unarmed condition; and wherein said locking member is centrifugally urged away from said keyed portion against a biasing force of said biasing element only when said fuze housing is deployed from an airborne projectile and said fuze housing is caused to rotate about a longitudinal axis thereof at a rotational speed exceeding about 2500 rpm, to thereby allow said arming member to be urged into an armed condition.

2. The fuze of claim 1, wherein said centrifugal locking system comprises:

a pair of said locking members disposed in opposing relationship to one another on opposite sides of said keyed portion; and a pair of biasing elements disposed in opposing relationship to one another and engaged with respective ones of said locking members.

3. The fuze of claim 1, wherein said fuze further comprises:

a weight having a threaded bore;

wherein said arming member comprises an arming screw having a threaded portion engaged with said threaded bore when said arming screw is in said unarmed position; and a slide member held in an unarmed position by said arming screw when said arming screw is in said unarmed condition and moveable to an armed position when said arming screw is unthreaded from said threaded bore and moves into said armed condition.

4. The fuze of claim 1, wherein said biasing element comprises a metal plate having an integrally formed pair of biasing arms for engaging said locking member.

5. The fuze of claim 1, wherein said locking member comprises a cut-out forming approximately one-half of a semi-hexagonal opening.

6. The fuze of claim 1, wherein said keyed portion comprises a hexagonal shape when viewed in cross section.

7. The fuze of claim 1, wherein said biasing force provided by said biasing element is sufficient to prevent rotation of said arming member unless said fuze and its said munition are rotating at a rate of at least about 5000 rpm.

8. A fuze for a munition adapted to become armed only when said munition is deployed from an airborne projectile, said fuze comprising:

a fuze housing;

a weight disposed within said housing and having a threaded bore;

an arming screw disposed partially within said housing and having a threaded portion and an a keyed portion;

a centrifugal locking system having at least one locking member and a biasing element for biasing said locking member into engagement with said keyed portion of said arming screw to thereby prevent said arming screw from being unthreaded and to maintain said arming screw in an unarmed condition; and wherein said locking member is centrifugally urged away from said keyed portion against a biasing force of said biasing element only when said fuze housing is deployed from an airborne projectile and said fuze housing is caused to rotate about a longitudinal axis thereof at a rotational speed exceeding about 2500 rpm, to thereby allow said arming screw to be urged into an armed condition.

9. The fuze of claim 8, wherein said centrifugal locking system comprises a pair of opposing locking members each adapted to engage said keyed portion of said arming screw.

10. The fuze of claim 8, wherein said centrifugal locking system comprises:

a pair of said biasing elements disposed in opposing relationship to one another;

a pair of said locking members disposed in opposing relationship to one another on opposing sides of said keyed portion; and wherein said biasing elements bias said locking members towards one another.

11. The fuze of claim 10, wherein said biasing elements comprises portions of a steel plate formed so as to engage a respective one of said locking members and exert a biasing force thereon.

12. The fuze of claim 8, wherein said keyed portion of said arming screw comprises a hexagonal shape.

13. The fuze of claim 8, wherein said locking member comprises a cutout portion having a hexagonal shaped recess.

14. The fuze of claim 8, wherein said keyed portion of said arming screw comprises a hexagonal shape;

wherein said locking member comprises a cutout portion; and wherein said cutout portion is engaged with said keyed portion of said arming screw when said fuze is in said armed condition.

15. A method for preventing a fuze of a munition adapted to be deployed from an airborne projectile from becoming armed unless said fuze and its said munition are deployed from an airborne projectile, the method comprising the steps of:

providing an arming member having a keyed portion disposed within a housing of said fuze;

using a locking member to engage said keyed portion when said arming member is in an unarmed condition;

using a biasing member to hold said locking member against said keyed portion until said fuze reaches an approximate minimum predetermined rotational rate;

selecting said biasing member to provide a biasing force which can be overcome by centrifugal force acting on said locking member when said fuze is rotated about a longitudinal axis thereof at a rate of at least about 5000 rpm.

16. The method of claim 15, further comprising the step of coupling a weight to said arming member; and disposing a detonator longitudinally in line with said arming member when said arming member is moved into said armed position, said weight assisting said arming member in impinging said detonator when said fuze and its associated munition strike a ground surface of target.

17. The method of claim 15, wherein said step of using said arming member comprises using an arming member having a keyed portion; and wherein said step of using said locking member comprises the step of using a locking member having a cut-out shaped in accordance with a cross sectional shape of said keyed portion to thereby positively engage said keyed portion when said arming member is in said unarmed condition.

18. A fuze for a munition adapted to become armed only when said munition is deployed from an airborne projectile and in a rapidly spinning condition, said fuze comprising:

a fuze housing;

a weight disposed within said housing and having a threaded bore;

an arming screw disposed partially within said housing and having a threaded portion and an a keyed portion, said threaded portion engaged within said threaded bore of said weight;

a centrifugal locking system including:

at least one locking member having a cut-out portion disposed so as to engage said keyed portion of said arming screw when said arming screw is in an unarmed position; and a biasing element disposed adjacent said locking member for biasing said locking member into engagement with said keyed portion to thereby prevent said arming screw from being unthreaded and to maintain said arming screw in said unarmed position; and wherein said locking member is centrifugally urged away from said keyed portion against a biasing force of said biasing element only when said fuze housing is deployed from an airborne projectile and said fuze housing is caused to spin about a longitudinal axis thereof at a rotational speed exceeding about 2500 rpm, to thereby allow said arming screw to be urged from said unarmed position into an armed position able to detonate said munition associated therewith.

19. The fuze of claim 18, wherein said cut-out of said locking member comprises a portion of a hexagonal shaped opening.

20. The fuze of claim 18, wherein said keyed portion comprises a hexagonal shape when viewed in cross section.

21. The fuze of claim 18, wherein said centrifugal locking system comprises a pair of locking members disposed in opposing relationship to one another on opposite sides of said keyed portion; and wherein said biasing element comprises a pair of biasing members for urging said locking members toward one another.

* * * * *